US009265986B1

(12) United States Patent
Godak

(10) Patent No.: US 9,265,986 B1
(45) Date of Patent: Feb. 23, 2016

(54) FULL BODY EXERCISE EQUIPMENT

(71) Applicant: Jacob D. Godak, Belgrade, MT (US)

(72) Inventor: Jacob D. Godak, Belgrade, MT (US)

(73) Assignee: Primus Exerceo LLC, Belgrade, MT (US)

( * ) Notice: Subject to any disclaimer, the term of this patent is extended or adjusted under 35 U.S.C. 154(b) by 35 days.

(21) Appl. No.: 13/999,446

(22) Filed: Feb. 26, 2014

Related U.S. Application Data

(60) Provisional application No. 61/850,927, filed on Feb. 26, 2013.

(51) Int. Cl.

| | |
|---|---|
| ***A63B 21/04*** | (2006.01) |
| ***A63B 22/20*** | (2006.01) |
| ***A63B 21/00*** | (2006.01) |
| *A63B 23/035* | (2006.01) |

(52) U.S. Cl.
CPC ..... *A63B 22/20* (2013.01); *A63B 21/1488* (2013.01); *A63B 22/201* (2013.01); *A63B 22/203* (2013.01); *A63B 23/035* (2013.01)

(58) Field of Classification Search
CPC ..... A63B 21/1488; A63B 21/1496; A63B 21/148; A63B 21/1403; A63B 21/1423; A63B 21/1426; A63B 21/143; A63B 21/1434; A63B 21/1438; A63B 21/1442; A63B 21/1446; A63B 21/00; A63B 21/00043; A63B 21/02; A63B 21/04; A63B 21/0407; A63B 21/0428; A63B 21/0442; A63B 21/055; A63B 21/0552; A63B 22/0012; A63B 22/0015; A63B 22/14; A63B 22/20; A63B 22/201; A63B 22/203; A63B 2022/0025; A63B 2022/0028; A63B 2022/0038; A63B 2022/0041; A63B 23/02; A63B 23/0227; A63B 23/035; A63B 23/03516; A63B 23/03533; A63B 23/03541; A63B 23/03575; A63B 21/0414; A63B 21/045; A63B 21/068; A63B 21/1465; A63B 22/00015; A63B 22/0087; A63B 2022/003; A63B 2022/0033; A63B 2022/0335; A63B 2022/0043; A63B 23/0205; A63B 23/0222; A63B 23/0233; A63B 22/21
See application file for complete search history.

(56) References Cited

U.S. PATENT DOCUMENTS

| | | | | |
|---|---|---|---|---|
| 3,589,720 | A | 6/1971 | Agamian | |
| 4,679,786 | A | 7/1987 | Rodgers | |
| 5,224,909 | A | 7/1993 | Hamilton | |
| 7,780,585 | B1 * | 8/2010 | Rivas | 482/140 |
| 7,931,570 | B2 * | 4/2011 | Hoffman | 482/123 |
| 7,951,050 | B2 | 5/2011 | Raumann et al. | |
| 7,998,043 | B2 | 8/2011 | Zhou et al. | |
| 8,137,250 | B1 | 3/2012 | Caban | |
| 8,137,251 | B2 | 3/2012 | Tozzi | |
| 8,500,611 | B2 | 8/2013 | Hoffman | |
| 9,011,296 | B2 * | 4/2015 | Peralo | 482/66 |
| 2006/0019806 | A1 | 1/2006 | Mikulski | |
| 2010/0216615 | A1 | 8/2010 | Rios et al. | |
| 2012/0244998 | A1 | 9/2012 | Rao | |

* cited by examiner

*Primary Examiner* — Loan H Thanh
*Assistant Examiner* — Megan Anderson
(74) *Attorney, Agent, or Firm* — Merchant & Gould, P.C.

(57) ABSTRACT

Full body exercise equipment including four elongate rails arranged in a generally side-by-side longitudinal configuration. The four elongate rails are connected together to allow for selected angular arrangements between the rails and also allow for selected longitudinal arrangements between the rails. A slidable shuttle member is provided on each rail with the two inside rails having toe holds and the two outside rails having hand grips. A resilient cord is provided for each shuttle for selectable attachment to either end of the shuttle to provide selected resistance against slidable movement of the shuttle in either direction on a respective rail.

19 Claims, 16 Drawing Sheets

FULL BODY EXERCISE EQUIPMENT

This application claims the benefit of provisional application Ser. No. 61/850,927 filed Feb. 26, 2013.

BACKGROUND OF INVENTION

The present invention relates to full body exercise equipment. In using this equipment a user's arms and legs are exercised at the same time for muscular development. The equipment is completely adjustable to allow for different exercise configurations.

Exercise devices are known such as described in U.S. Pat. No. 4,679,786 which describes four slides, one for each limb, slidably movable along parallel paths enabling reciprocating motion. Resistance to the reciprocating motion is accomplished with elongate cables engaging gears, clutches, a fly wheel and a power dissipating device such as a generator.

SUMMARY OF INVENTION

The present invention includes four elongate rails arranged in a generally side-by-side longitudinal configuration. The four elongate rails are connected together to allow for selected angular arrangements between the rails and also allow for selected longitudinal arrangements between the rails.

A slidable shuttle member is provided on each rail with the two inside rails having toe holds and the two outside rails having hand grips.

A resilient cord is provided for each shuttle for selectable attachment to either end of the shuttle to provide selected resistance against slidable movement of the shuttle in either direction on a respective rail.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
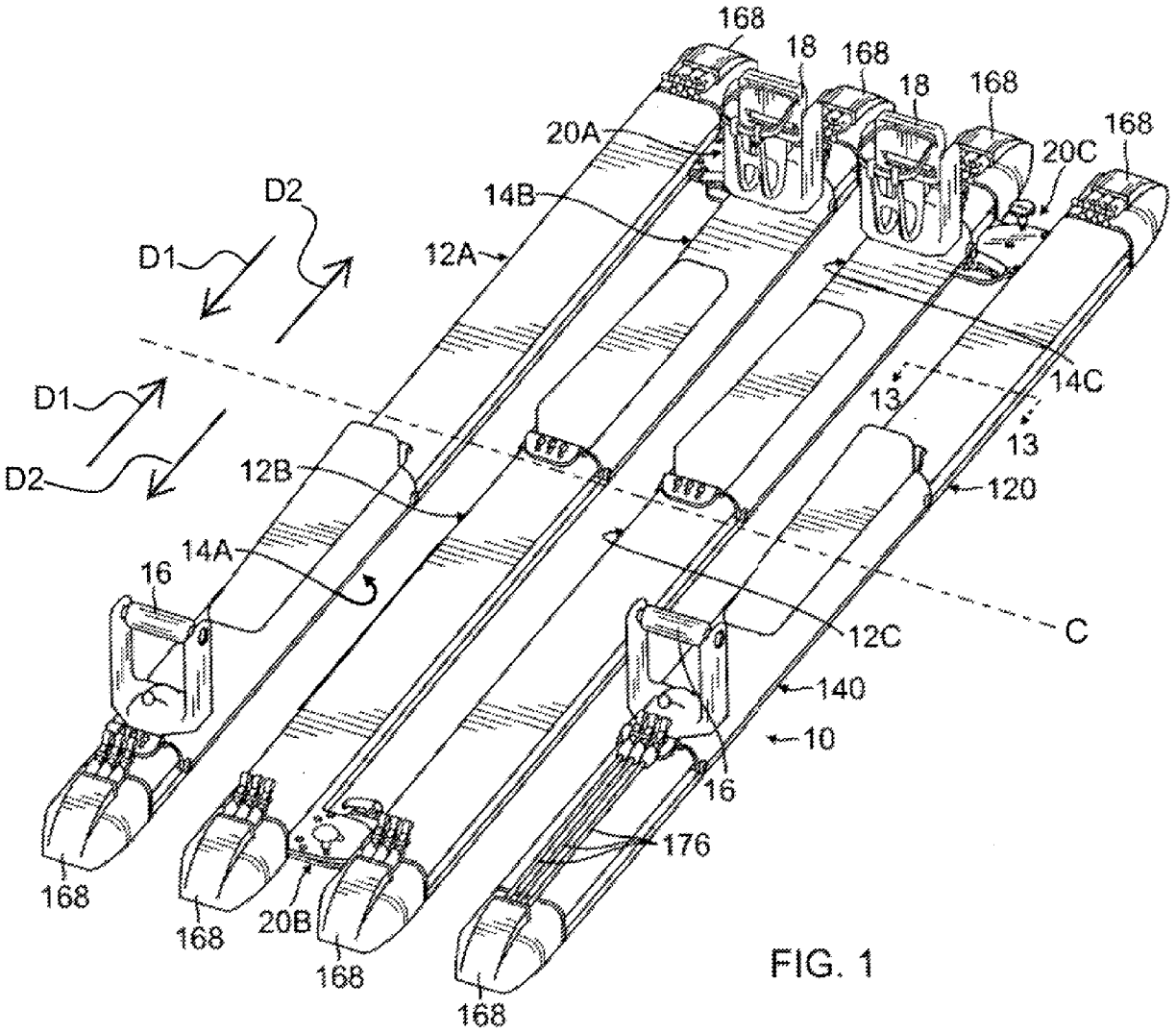
FIG. 1 is a perspective plan view of a full body exercise equipment according to the present invention.
Figure 2:
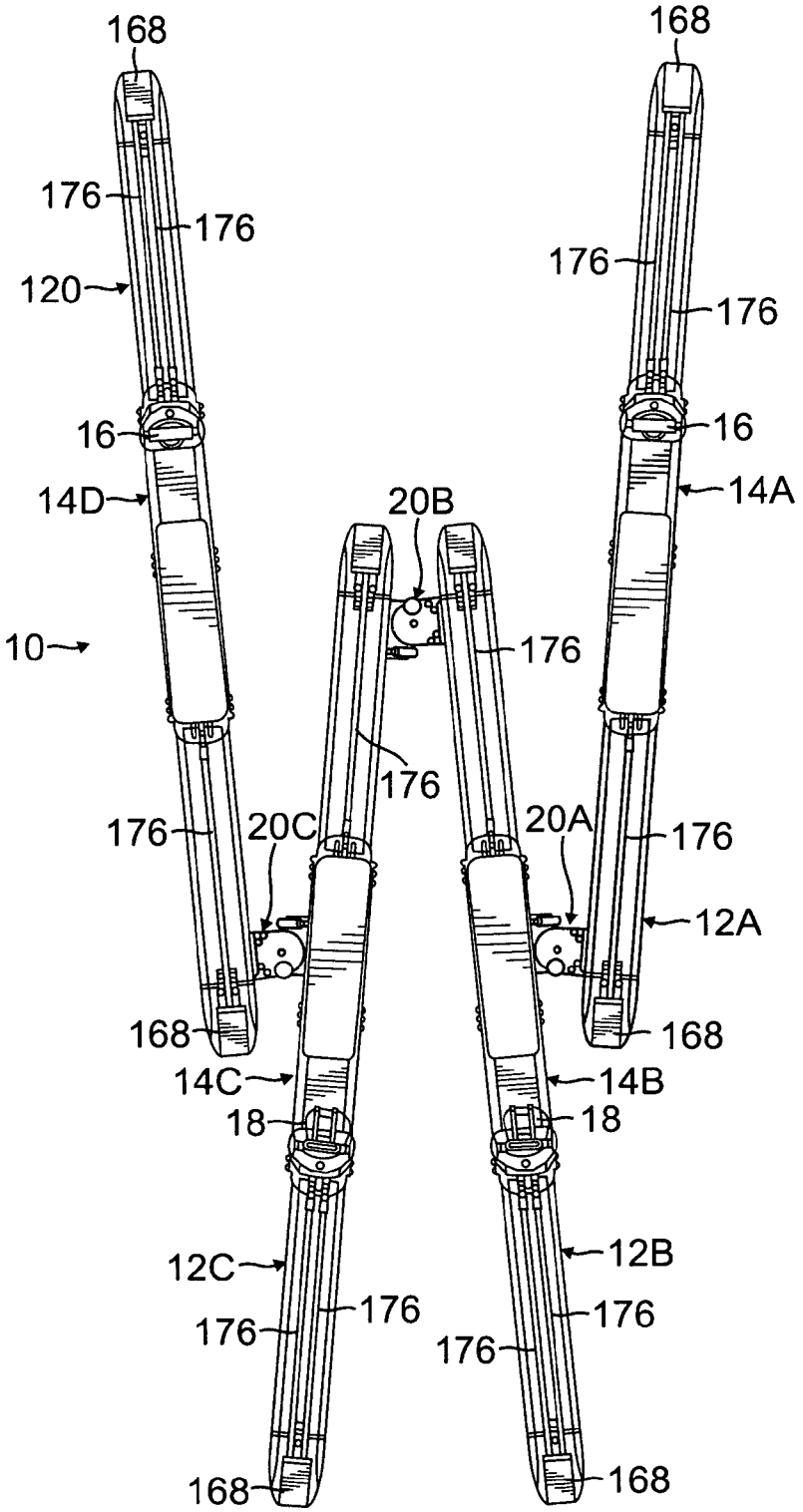
FIG. 2 is a plan view of the equipment shown in FIG. 1 used in a different configuration.

A full body exercise equipment 10 is shown in FIGS. 1 and 2. This equipment includes four identical elongate rails 12A, 12B, 12C and 12D. Four identical shuttle members 14A, 14B, 14C and 14D are each mounted to a respective rail 12A, 12B, 12C and 12D. The center of the exercise equipment 10 is indicated by centerline C. The shuttle members 14A-14D are configured to slide on the rail in an inward direction D1 towards the centerline C and in an outward direction D2 away from the centerline C. A hand grip 16 is mounted to each of the shuttles 14A and 14D. A conventional toe hold 18, which also refers to a foot support, is mounted to each of the shuttles 14B and 14C.

A rotatable slide 20A is mounted to edges of adjacent rails 12A and 12B. A rotatable slide 20B is mounted to edges of adjacent rails 12B and 12C. A rotatable slide 20C is mounted to edges of adjacent rails 12C and 12D as shown in FIGS. 1 and 2. The rotatable slides 20A, 20B and 20C are of identical construction and are mounted to the rails 12A, 12B, 12C and 12D in a manner which will be described below.

Figure 3:
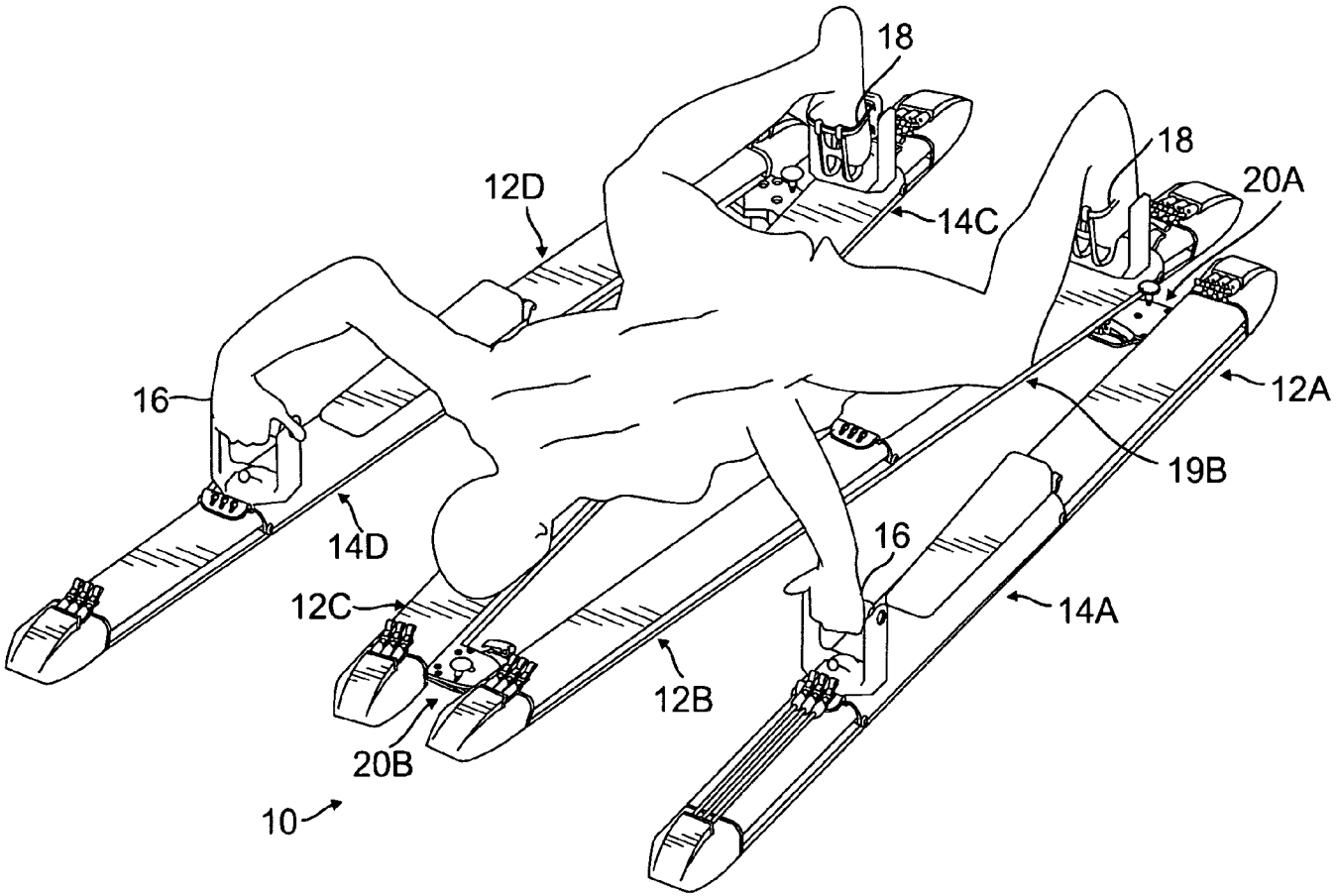
FIG. 3 is a perspective view of a user using the equipment shown in FIG. 2.

The equipment 10 may be used for exercise as illustrated in FIG. 3.

Figure 4:
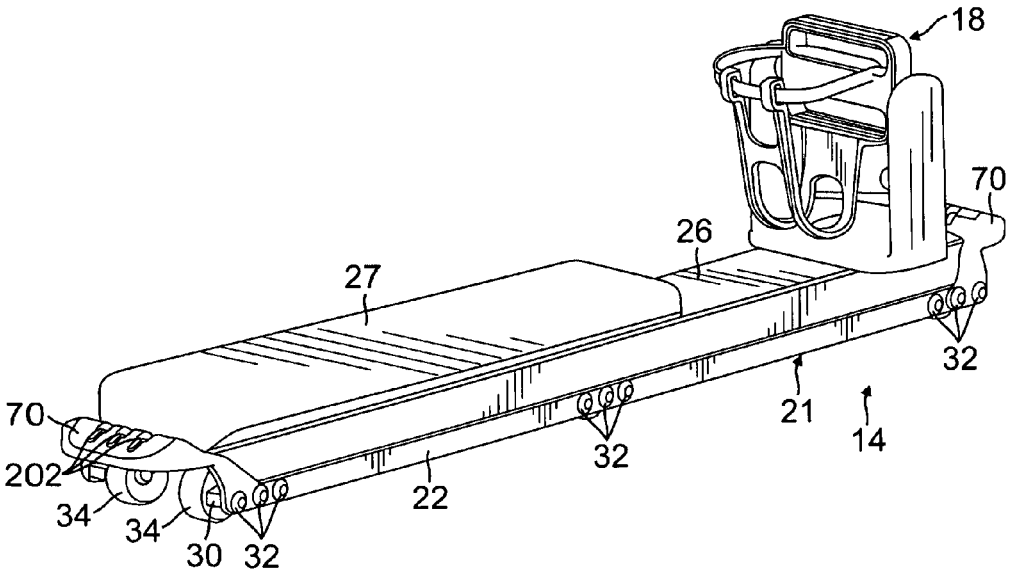
FIG. 4 is a perspective view of a shuttle having a toe hold used with the present invention.
Figure 5:
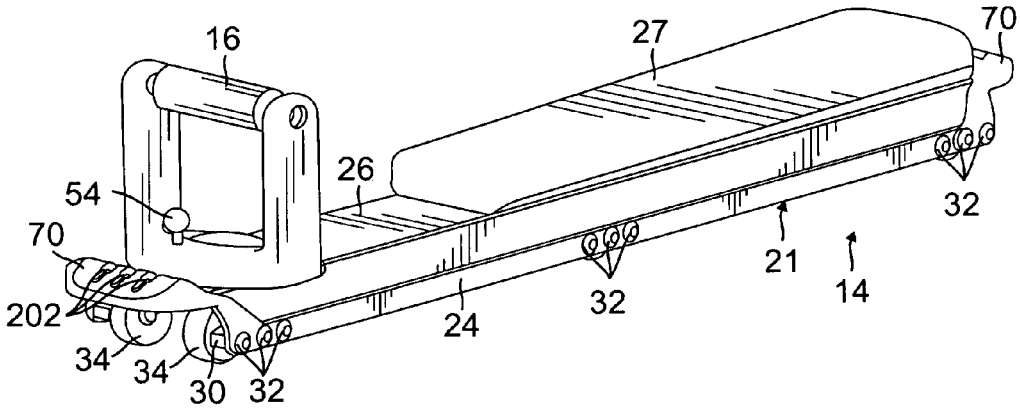
FIG. 5 is a perspective view of a shuttle having a hand grip used with the present invention.
Figure 6:
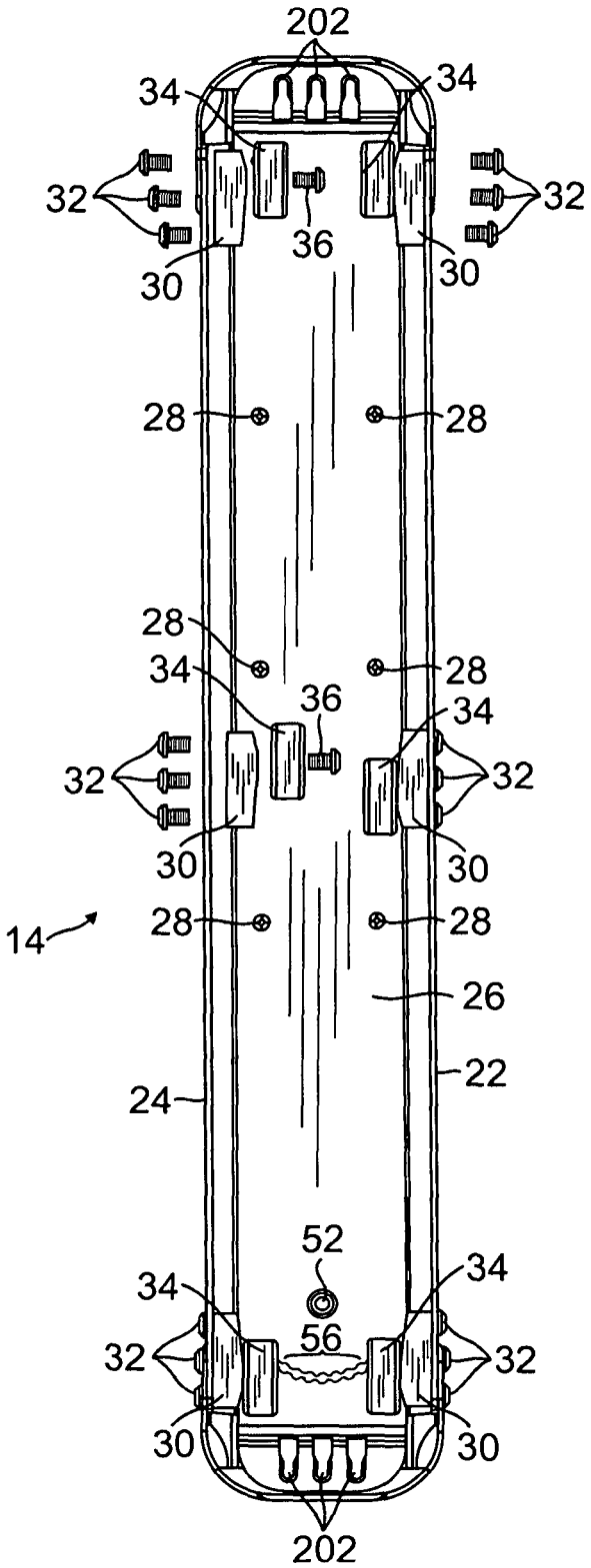
FIG. 6 is a bottom plan view of the shuttles shown in FIGS. 4 and 5.

The shuttles 14A, 14B, 14C and 14D all have identical construction and are collectively referred to as a shuttle 14. A perspective view of a shuttle 14 to which is mounted a toe hold 18 is shown in FIG. 4. A perspective view of a shuttle to which is mounted a hand grip 16 is shown in FIG. 5. A bottom plan view of each of the shuttles 14A, 14B, 14C and 14D is shown in FIG. 6 with the designation 14. The shuttles 14 have a body 21 including parallel sidewalls 22 and 24. A top cover 26 is moulded to the sidewalls 22 and 24 as shown in FIGS. 4 and 5. A pad 27, which also refers to a knee support, is secured to the top cover 26 with screws extending through screw holes 28 (shown in FIG. 6) in the top cover 26.

Wheel support blocks 30 are mounted to the sidewalls 22 and 24 with screws 32 as shown in FIG. 6. Wheels 34 are rotatably mounted to the wheel support blocks 30 with a screw axle 36.

Figure 7:
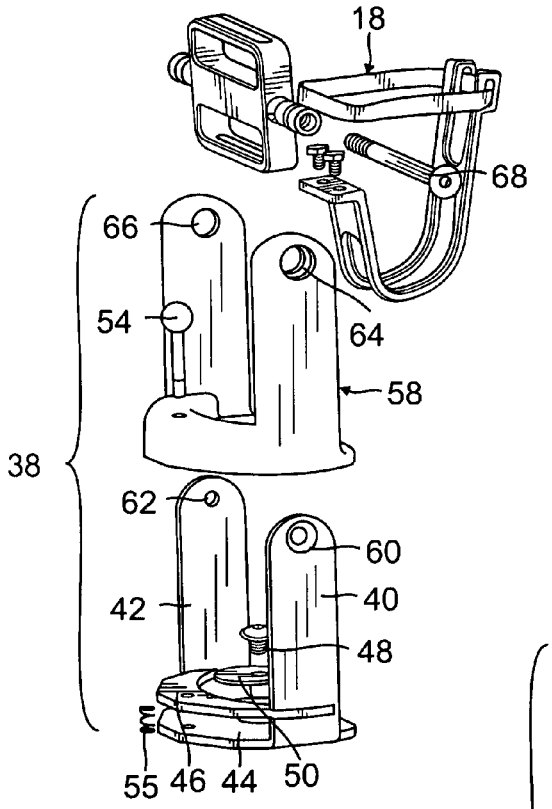
FIG. 7 is an exploded view of a toe hold and mounting structure shown in FIG. 4.
Figure 8:
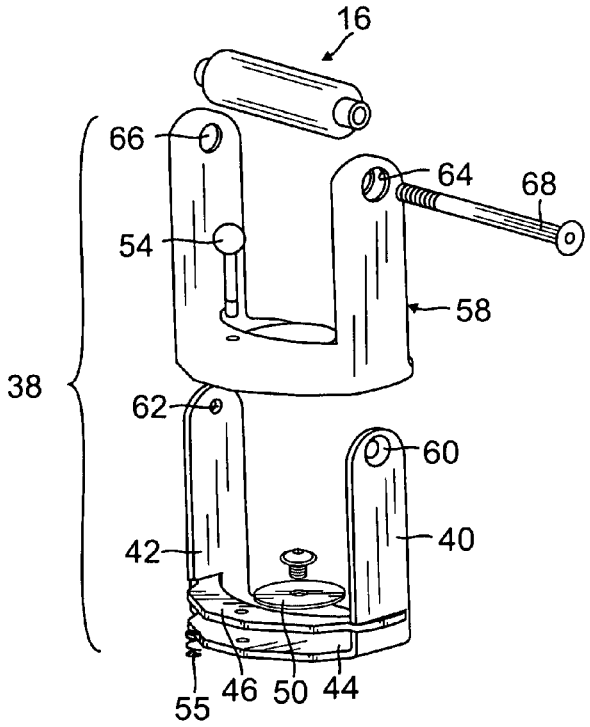
FIG. 8 is an exploded view of a hand grip and mounting structure shown in FIG. 5.

The hand grip 16 and toe hold 18 are each mounted to a shuttle 14 with an identical mounting structure 38 as shown in FIGS. 7 and 8. The mounting structure 38 includes a pair of upright support members 40 and 42 adjoined together with a bottom plate 44. A bracing plate 46 spaced apart from the bottom plate 44 extends between the upright members 40 and 42 as shown in FIGS. 7 and 8. A pivot screw 48 extends through a washer 50 resting on top of the bottom plate 44 and then through a hole provided in the bottom plate 44 and screwed into a screw hole 52 (shown in FIG. 6) provided in the top cover 26. The friction fit of pivot screw 48 in screw hole 52 is adjusted to allow the mounting structure 38 to pivot about the pivot screw 48.

A protective shroud 58 is sized and shaped to cover the upright members 40 and 42 and the bottom plate 44. The upright members 42 and 40 are provided with aligned holes 60 and 62 and the shroud 58 is provided with holes 64 and 66 aligned with holes 60 and 62, respectively. A pin 68 extends through the holes 64, 60, 62 and 66. The hand grip 16 is rotatably mounted on the pin 68 and the toe hold 18 is rotatably mounted on a respective pin 68.

Figure 9:
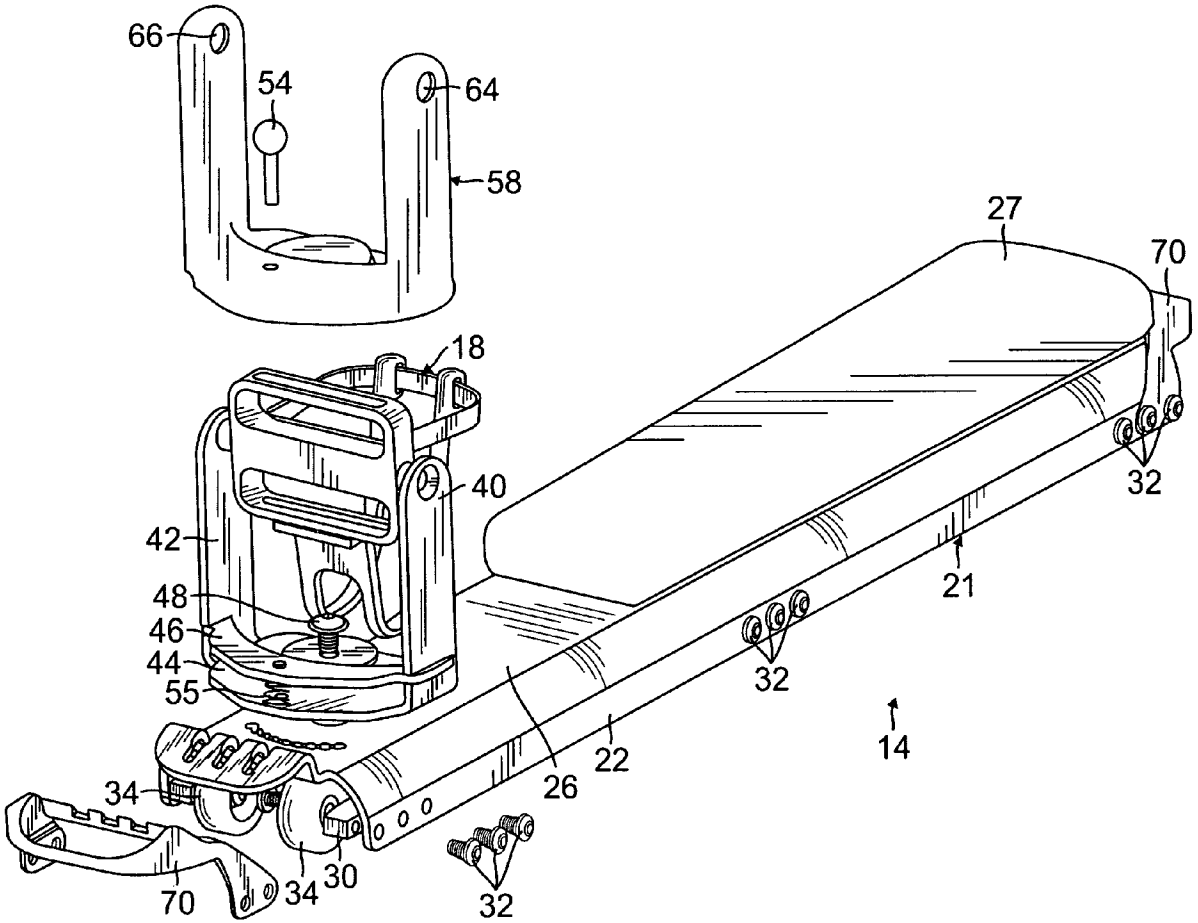
FIG. 9 is an exploded view of a toe hold mounted to a shuttle shown in FIG. 4.

As shown in FIG. 9, an adjustment pin 54 is provided for selectively locking the mounting structure 38 in a selected rotated position. The adjustment pin 54 extends through a hole provided in the shroud, then through a hole provided in the bracing plate 46 through a coil compression spring 55 through a hole provided in the bottom plate 44 and extending into a selected indexing hole 56 to allow the mounting structure 38 to be secured in a selected rotated position. By lifting the adjustment pin 54 against the bias force of the spring 55, the adjustment pin 54 is retracted from a selected index hole 56. The mounting structure 38 can then be rotated to a selected position and the adjustment pin 54 released. The compression spring 55 extends the end of the adjustment pin 54 into the selected index hole 56.

A cover 70 is mounted at each end of the shuttles 14 with the screws 32 as shown in FIGS. 4 and 5. FIG. 9 shows an exploded view of the cover 70 mounted to one end of the shuttle 14.

Figure 10:
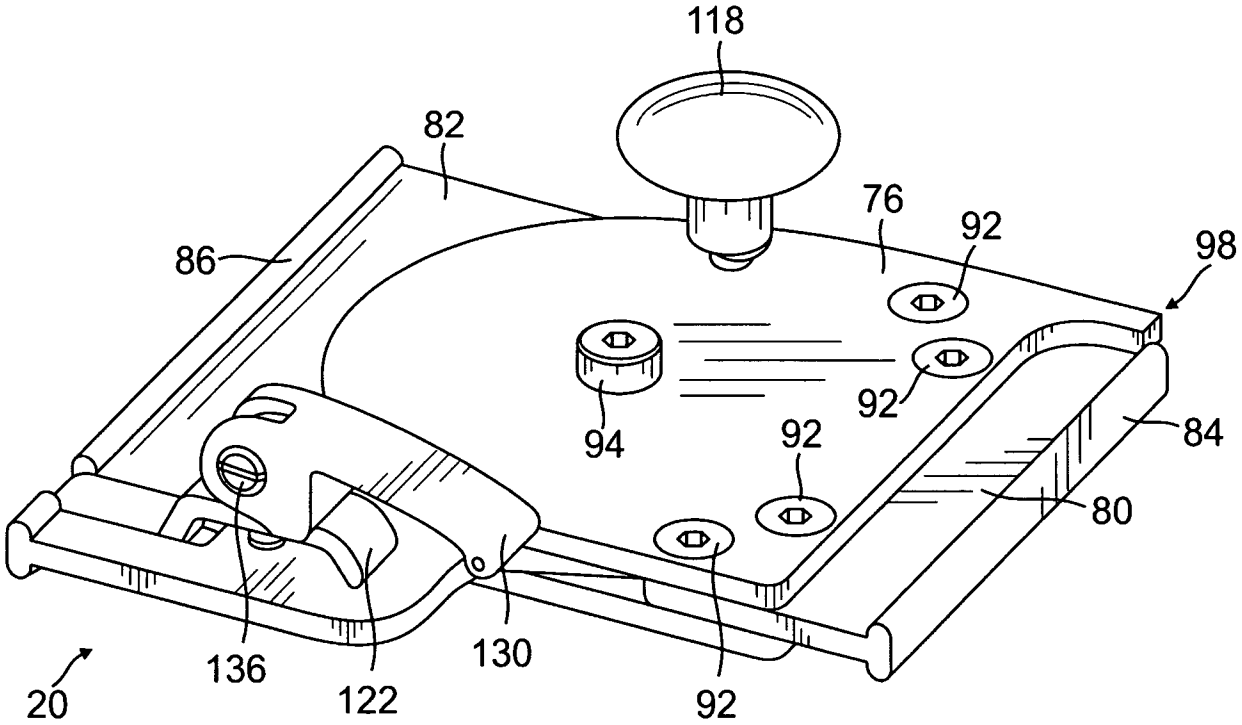
FIG. 10 is a perspective view of a rotatable slide used with the present invention.
Figure 11:
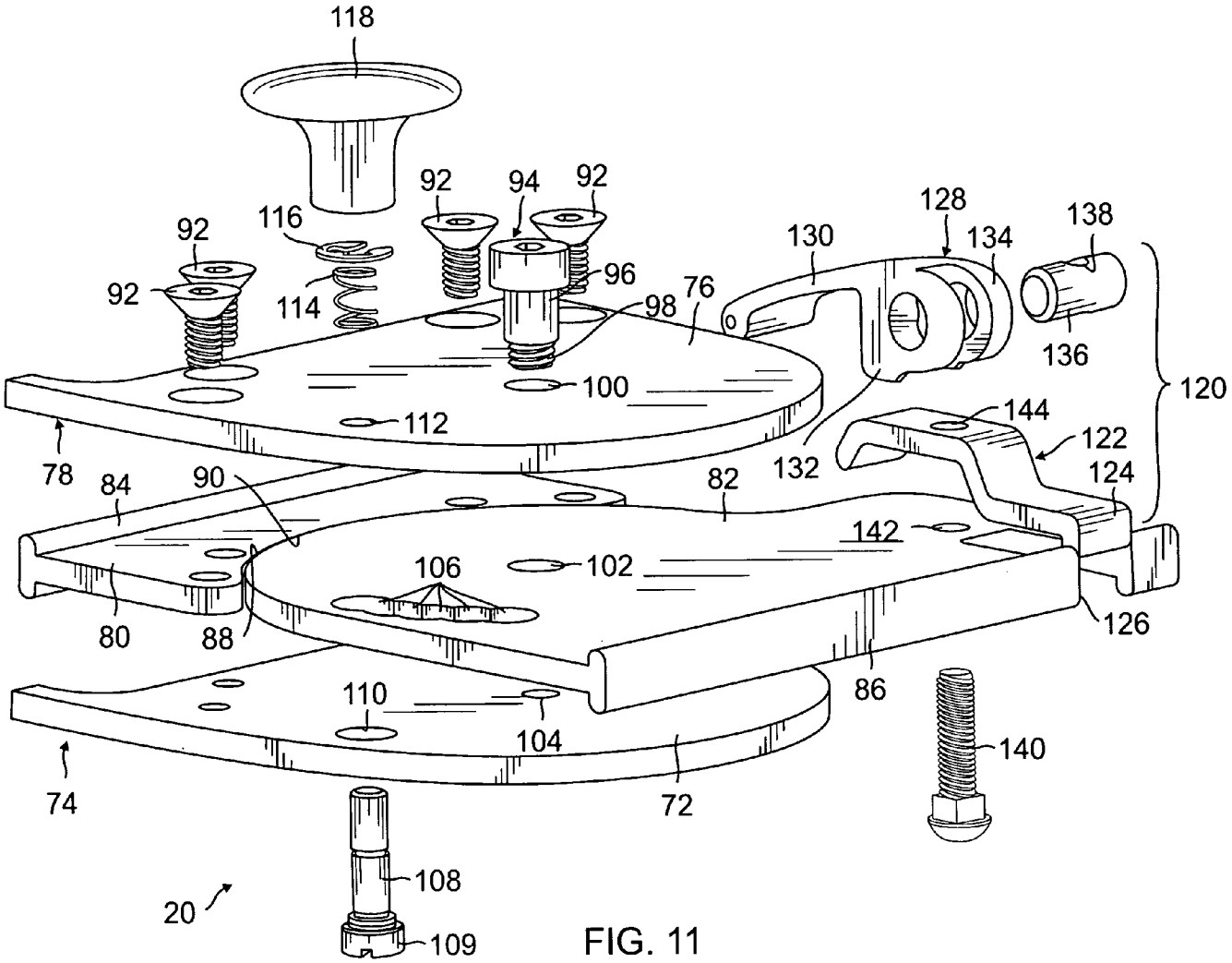
FIG. 11 is an exploded view of the rotatable slide shown in FIG. 10.

The rotatable slides 20A, 20B and 20C are of identical construction and are collectively denoted as element 20 in FIGS. 10 and 11. The rotatable slides 20 have a bottom plate 72 including a locking portion 74 to be described below. The rotatable slides 20 further includes a top plate 76 also having a locking portion 78 to be described below. Sandwiched between the bottom plate 74 and the top plate 76 are plates 80 and 82. The plate 80 includes a slide portion 84 and the plate 82 includes a slide portion 86. The plate 80 further includes a circular concave portion 88 and the plate 82 has a circular convex portion 90 sized to slidably mate with concave portion 88. The top plate 76, the plate 80 and the bottom plate 72 are fixedly secured together with screws 92. A pivot bolt 94 includes a shaft portion 96 and a threaded end portion 98. The pivot bolt 94 extends through a hole 100 provided in the top plate 76 and then is slidably received by hole 102 provided in the plate 82 and is threadably received by a hole 104 provided in the bottom plate 72. With this construction, the plate 82 will rotate about the pivot bolt 94 relative to the plates 72, 80 and 76 which are fixedly joined together.

A locking pin 108 having a head portion 109 is mounted to a pull handle 118 through a coil compression spring 114 and a lock washer 116. The locking pin 108 is sized to extend through hole 112 provided in top plate 76 with head 109 resting in a selected index hole 106 provided in plate 82 when pull handle 118 is in the resting position. The index holes 106 are sized to receive the head 109. When the pull handle 118 is pushed down against the resilient force of spring 114, the head 109 is forced out of the selected index hole 106 through opening 110 provided in the bottom plate 72. The plate 82 can then be rotated about the pivot bolt 94 to a selected position and the pull handle 118 released. The spring 114 causes the head 109 of pin 108 to move upwards into a newly selected index hole 106.

Figure 17:
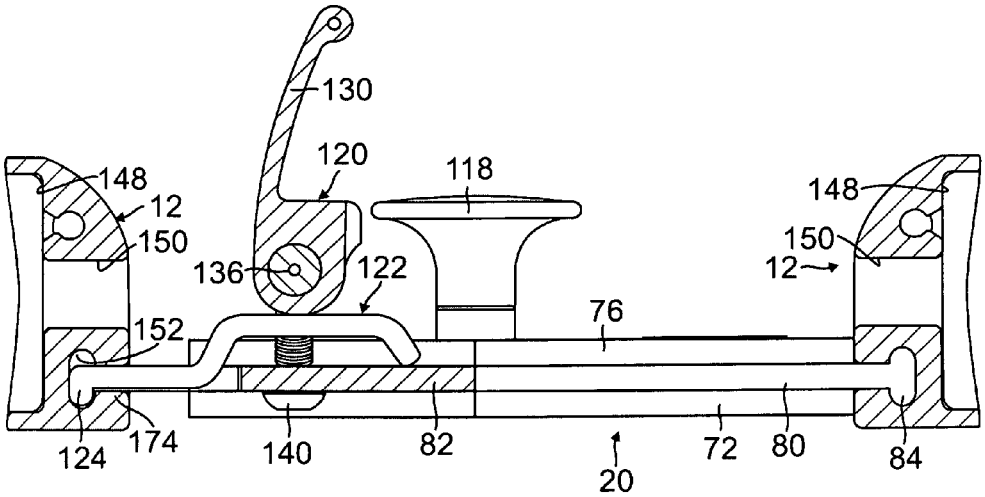
FIG. 17 is a cross sectional view with parts broken away showing the connection of a rotatable slide between two adjacent rails with a locking handle in a release position.
Figure 18:
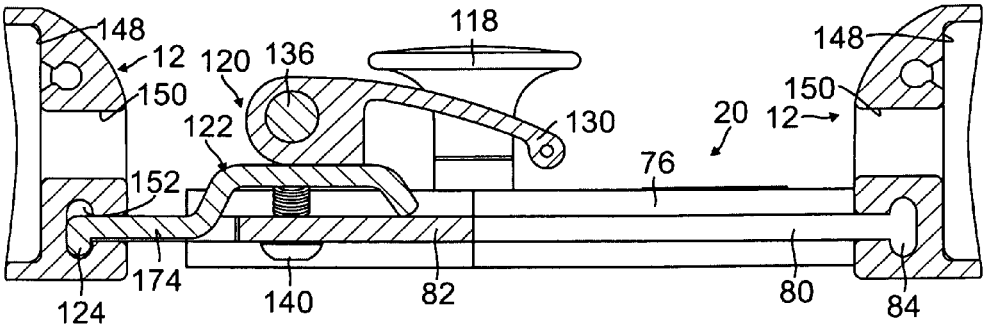
FIG. 18 is a cross sectional view of the structure shown in FIG. 17 with a locking handle in a locked position.
Figure 19:
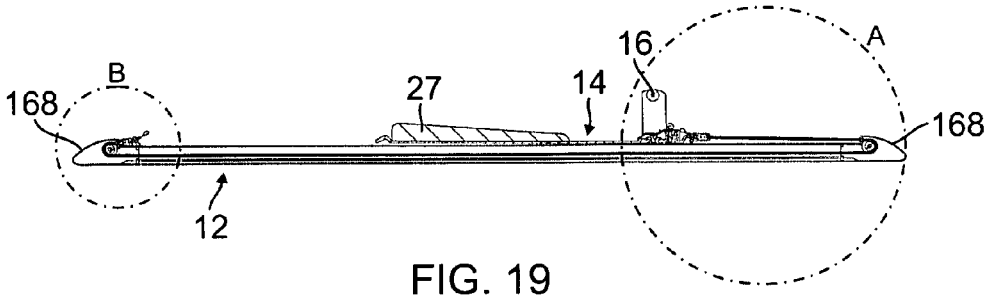
FIG. 19 is a longitudinal cross sectional elevational view of a rail having a shuttle mounted thereon.

A latching mechanism 120 is provided to lock the slide portion 86 to a rail 12 as described below. The latching mechanism includes a latch member having an end portion 124 for extending into a cutout portion 126 provided in the plate 82 and slide portion 86. The end portion 124 is shaped and sized to fit within a keyway 152 as shown in FIGS. 17 and 18. A cam lever arm 128 includes a handle portion joined to two spaced apart arms 132 and 134. A pin 136 is sized to be slidably received by holes provided in arms 132 and 134. The pin 136 includes a threaded hole 138. A bolt 140 is slidably received by a hole 142 provided in middle plate 82 and a hole 144 provided in the latch member 122 and then is threadably received by hole 138.

The arms 132 and 134 of the handle 130 have a cam shape such that when the handle is lifted, the end portion 124 of the latch member 122 is allowed to rise and when the latch member 122 is moved to the down position, the end portion 124 is forced downwardly.

The rails 12A, 12B, 12C and 12D are all of identical construction. These rails will be collectively referred to as element 12 in FIGS. 12 and 13. The rails 12 include a central cavity 146 which extends longitudinally from one end of the rail to the opposite end of the rail. The rail 12 further includes wheel races 148 which extend from one end of the rail 12 to the opposite end of the rail 12 for rollably receiving wheels 34 of the shuttles 14. The rails also include longitudinal slots 150 extending from one end of the rail 12 to the opposite end of rail 12 for slidably receiving the wheel support blocks 30 of the shuttle 14. The rails 12 further include a longitudinal keyway provided on each side of the rail 12 for receiving the slide portion 84 or the slide portion 86 of a rotatable slide 20 as shown in FIG. 14.

Figure 12:
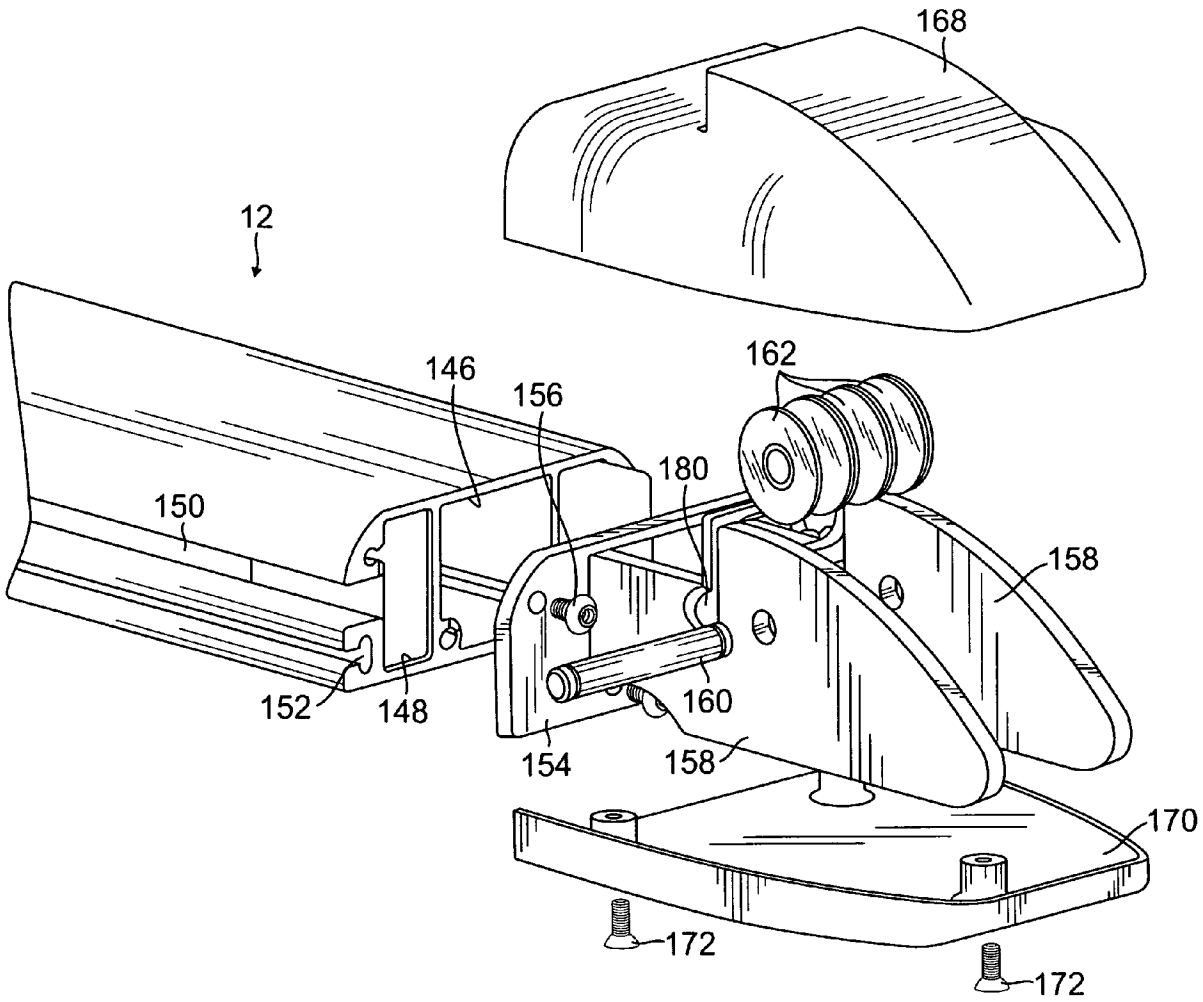
FIG. 12 is an exploded view of the end structure used at both ends of a rail used with the present invention.
Figure 13:
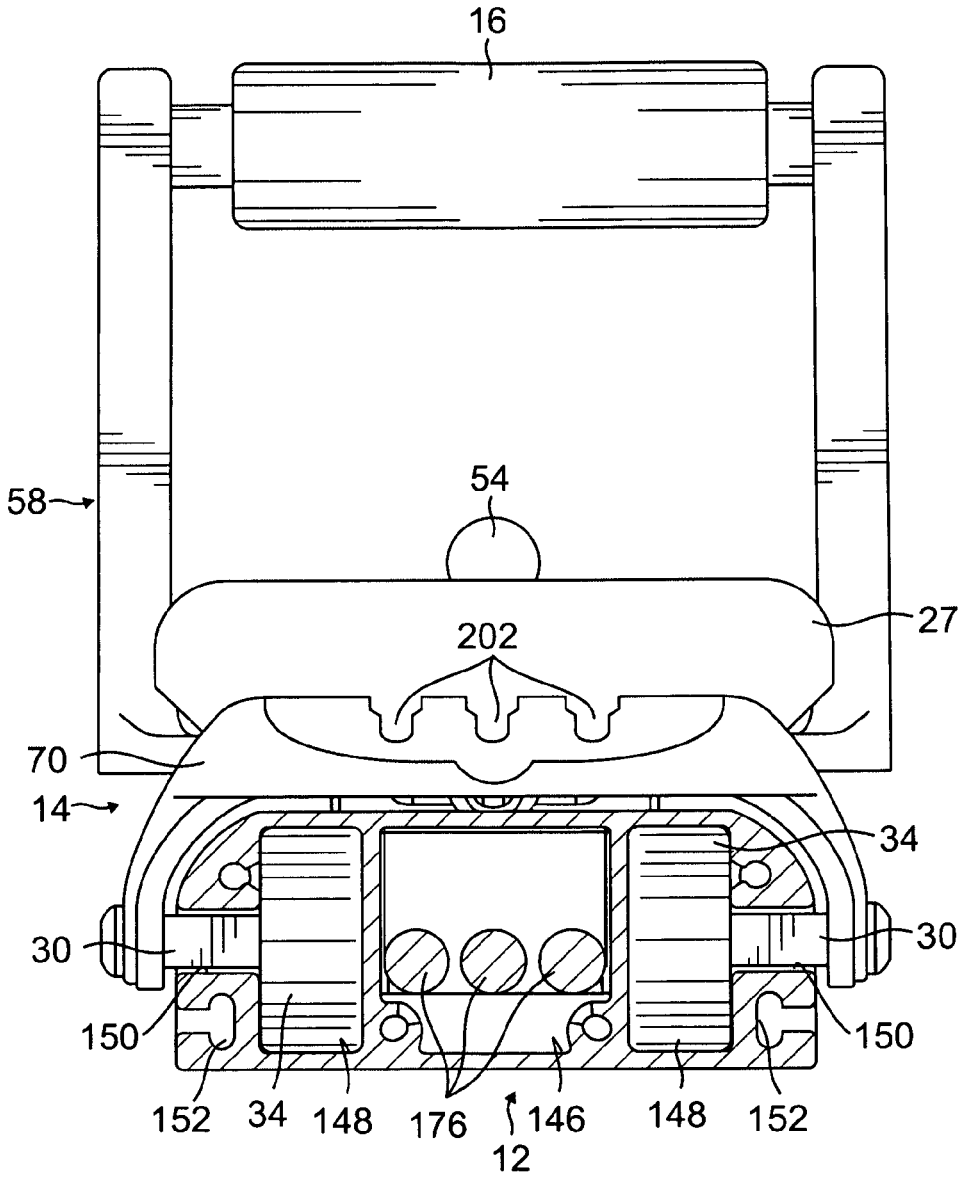
FIG. 13 is a cross sectional view taken along the line 13-13 in FIG. 1 of a shuttle mounted to a rail of the present in invention.
Figure 14:
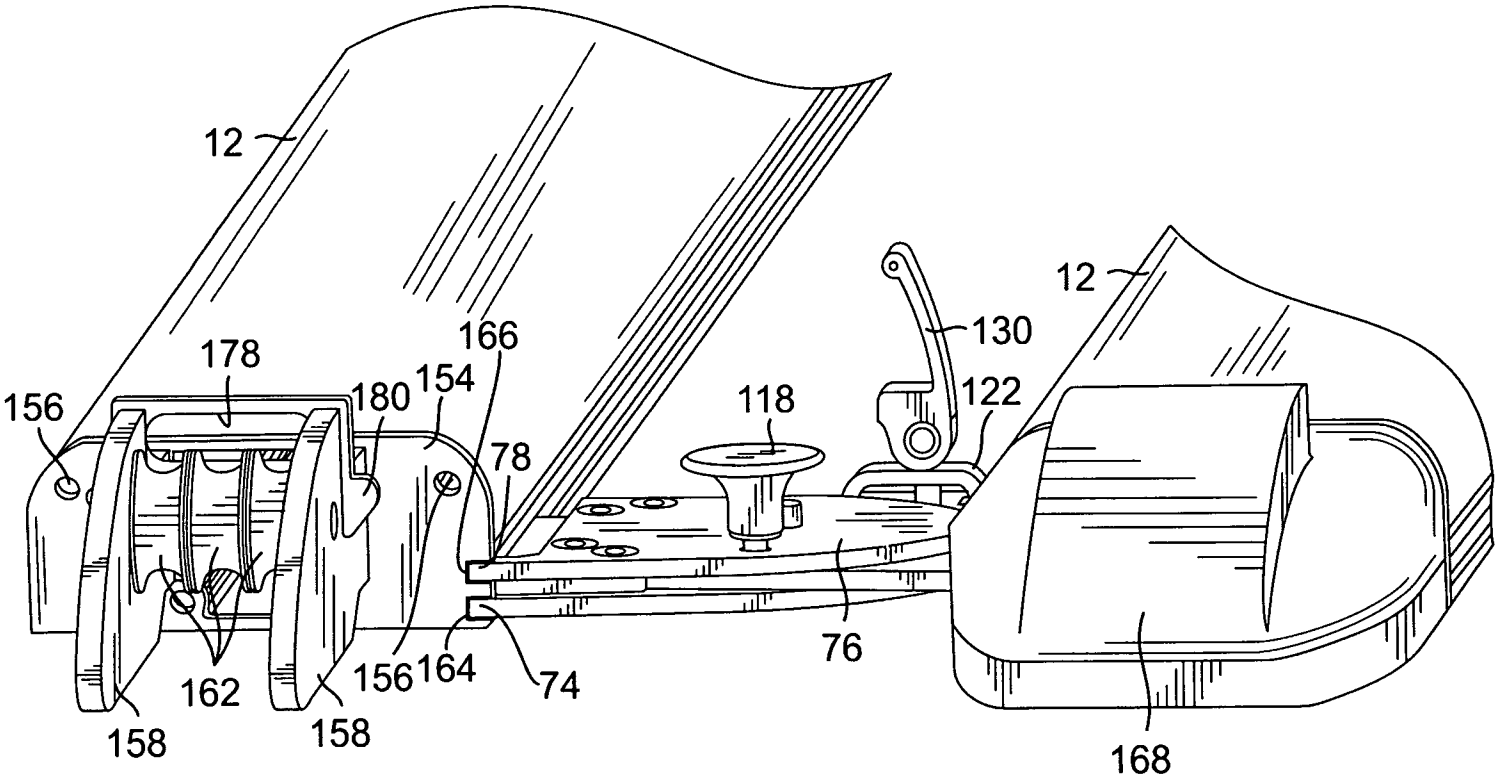
FIG. 14 is an end view with parts broken away of two rails joined together with a rotatable slide according to the present invention.

At each end of each rail 12, an end plate 154 is mounted to the rail 12 with screws 156 as shown in FIG. 14. Two opposed axle support plates 158 are secured to the end plate 154 as shown in FIGS. 12 and 14. An axle 160 is mounted within aligned holes provided in the axle support plates 158 and pulleys 162 are rotatably mounted on the axle 160 between the axle support plates 158 as shown in FIGS. 12 and 14.

Slots 164 and 166, provided in end plate 154, as shown in FIG. 14, receive the locking portions 74 and 78, respectively, of the rotatable slide 20 (shown in FIG. 11). With this arrangement, the locking portions 74 and 78 prevent the rotatable slide 20 from sliding on the rail 12 in which the locking portions are mounted. A shroud 168 is threadably secured to a base plate 170 positioned below the axle support plates 158 with screws 172.

Figure 15:
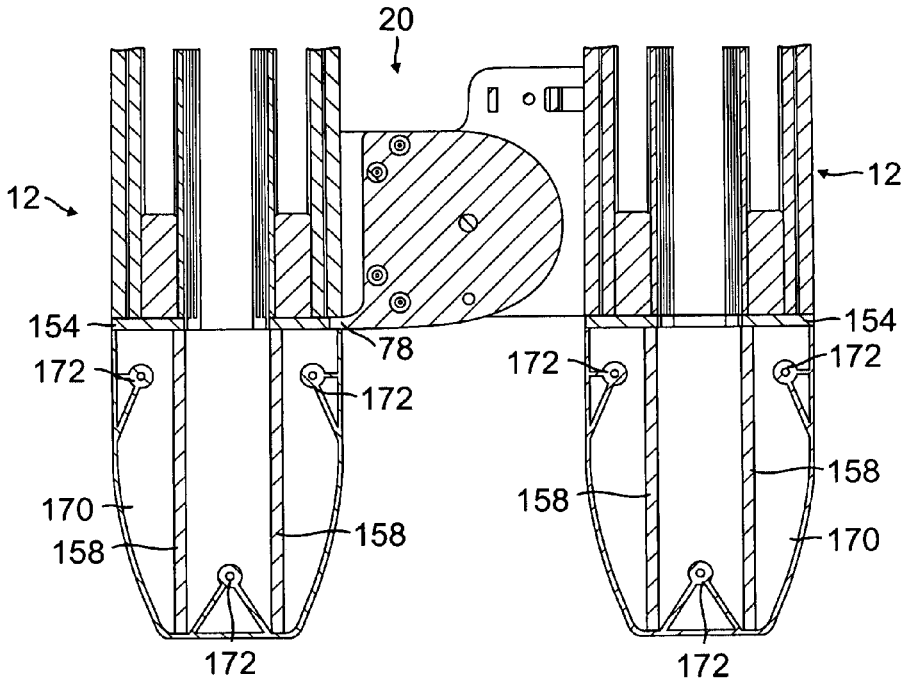
FIG. 15 is a cross sectional plan view of the structure shown in FIG. 14.
Figure 16:
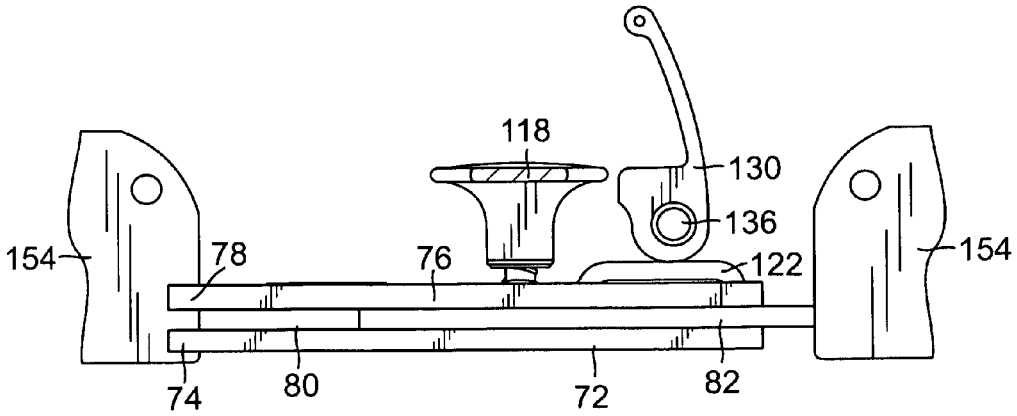
FIG. 16 is a partial end view with parts broken away of the structure shown in FIG. 14.

An end of the shroud 168 locks the locking portions 74 and 78 in the positions shown in FIG. 15. The shroud 168 prevents the locking portions 74 and 78 from being disengaged from the slots 166 and 164.

With the arrangement shown in FIG. 2, the locking portions 74 and 78 of rotatable slides 20A and 20C, as shown in FIG. 2, are locked on the outer rails 12A and 12D, respectively. The locking portions 74 and 78 of rotatable slide 20B are locked on rail 12B.

One side of the rotatable slide 20 is locked to a rail 12 as described above. The other side of the rotatable slide is releasably locked to an adjacent rail with the end portion 124 of the latch member 122 resting in the keyway 152. The handle 130 has a cam portion resting on the latch member 122. When the handle 130 is rotated upwardly, as shown in FIG. 17, the latch member 122 rides freely within the keyway 152, as shown in FIG. 17. When the handle 130 is rotated to the downward position as shown in FIG. 17, the latch member 122 is forced into frictional engagement with the wall 174. With latch member 122 in the raised position, the rotatable slide 20 will slide in the keyway 152 of the rail 12. When the latch member 122 is in the downward position, as shown in FIG. 18, the rotatable slide 20 is prevented from moving in the keyway 152.

As shown in FIGS. 1 and 2, the rotatable slide 20A is positioned with the latching mechanism 120 engaging rail 12B. The rotatable slide 20B is positioned with the latching mechanism 120 engaging rail 12C. Under normal conditions, the latching member 120 is positioned with the handle 130 in the downward position thereby locking rotatable slide 20B to both rails 12B and 12C. The rotatable slide 12C has the latching mechanism 120 in engagement with rail 12C. Under normal conditions, the latching members 120 of rotatable slides 20A and 20C are positioned with the handle 130 in the raised position thereby allowing rotatable slides 20A and 20C to slide on rails 12B and 12C, respectively.

Resilient cords 176 extend longitudinally through the rails 12 within cavity 146 as shown in FIGS. 12 and 19-21. The resilient cord 176 extends around a pulley 162 through an opening 178 provided in a cord guide plate 180 (shown in FIGS. 12 and 14) and is attached to a ball connector 182.

Figure 22:
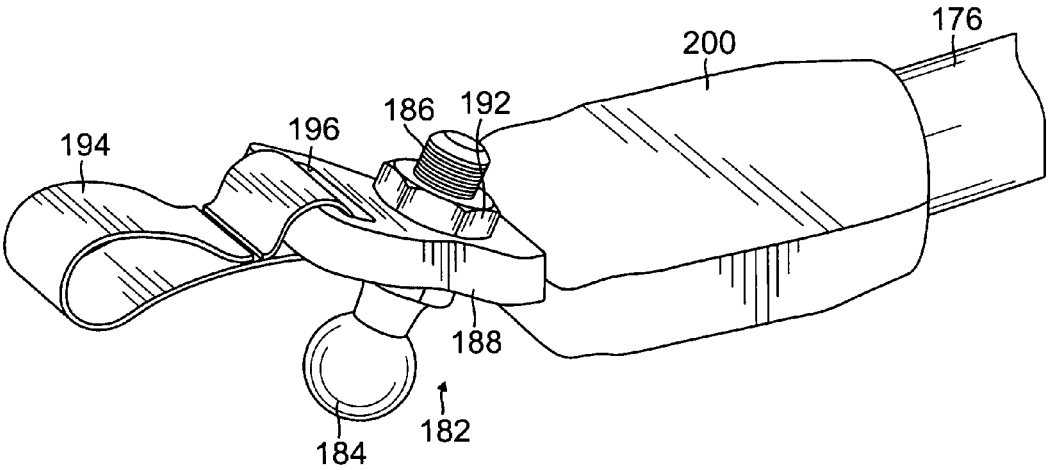
FIG. 22 is a detail view of a ball connector attached to each end of a resilient cord used with the present invention.
Figure 23:
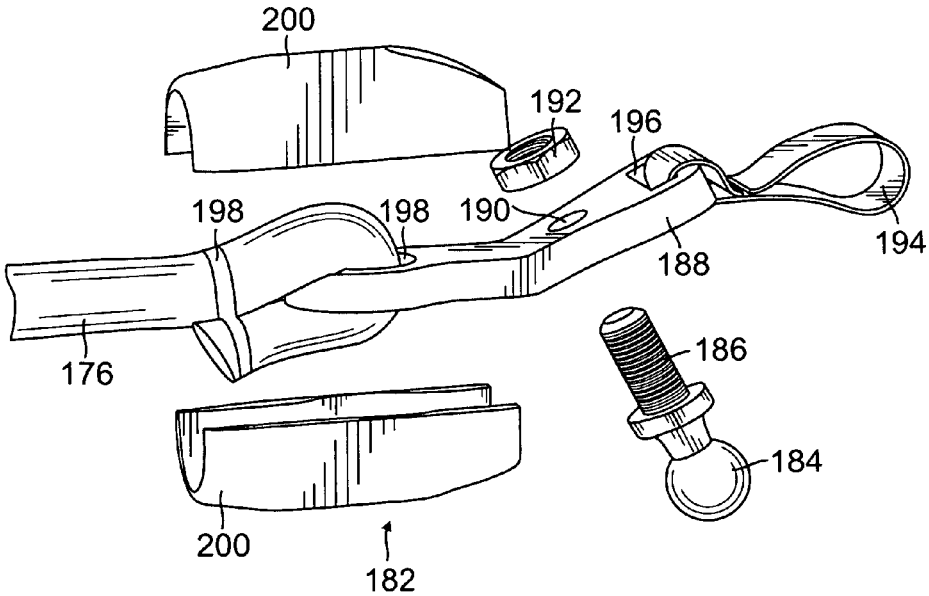
FIG. 23 is an exploded view of the ball connector shown in FIG. 22.

The ball connector 182 is shown in FIGS. 22 and 23. A ball 184 having a threaded shaft 186 is connected to a resilient cord attachment member 188 through a hole 190 with a nut 192. A pull strap 194 is connected to the cord attachment member 188 through an opening 196. The cord 176 is connected with the cord attachment member 188 by looping an end of the resilient cord 176 through an opening 198 provided in the cord attachment member 188 and then attaching the end of the resilient cord 176 to the cord 176 with a crimp 198. A clamshell cover having two halves are joined together to cover the connection of the cable 176 with the cord attachment member 188.

Figure 21:
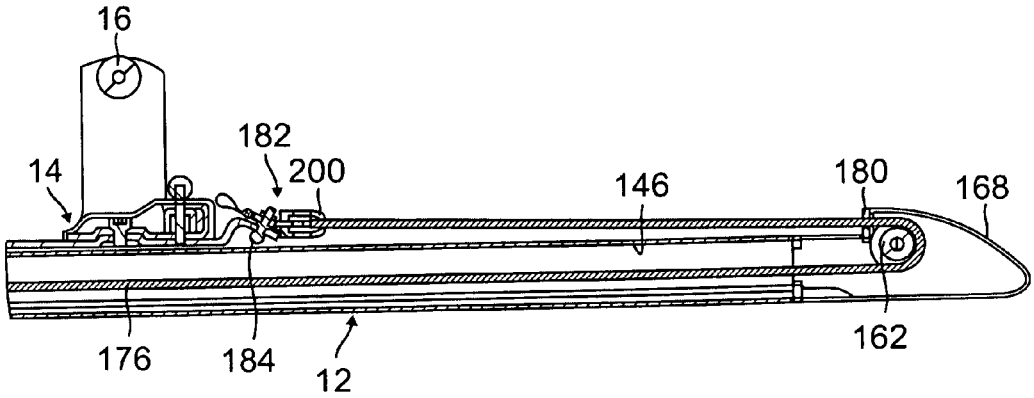
FIG. 21 is an enlarged detail view taken at "A" in FIG. 19.

An end of the resilient cord 176 may be connected to a shuttle 14 by inserting the ball 184 into a keyhole slot 202 as shown in FIGS. 4-6, and as shown in FIG. 21.

Figure 20:
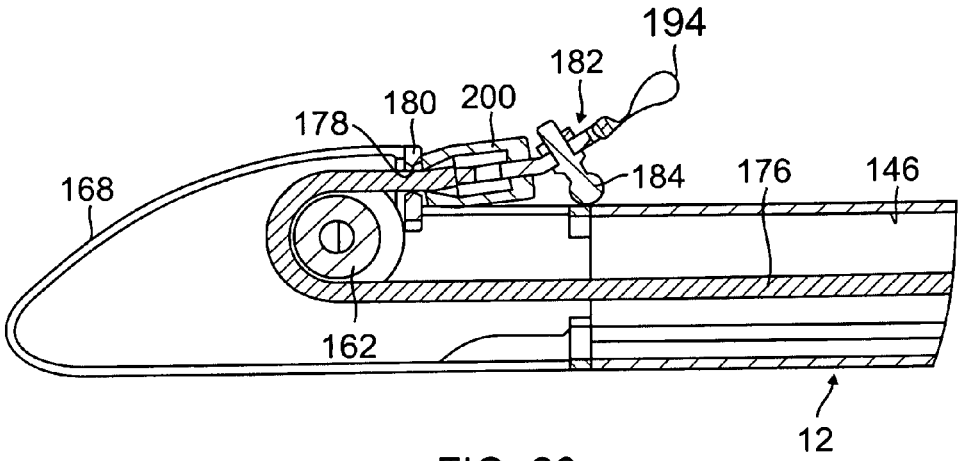
FIG. 20 is an enlarged detail view taken at "B" in FIG. 19.

When not connected to a shuttle, the resilient cord 176 rests against the cord guide plate 180 with the clamshell cover 200 preventing the ball connector 182 from being retracted through opening 178 as shown in FIG. 20.

In operation, the rails 12A, 12B, 12C and 12D may be angularly oriented with respect to one another with rotatable slides 20A, 20B and 20C. Two configurations of many are shown in FIGS. 1 and 2. To adjust the angular orientation, the pull handle 118 is pushed downwardly causing the head 109 of pin 108 to be moved out of a selected index hole 106. The plate 82 can then be rotated with respect to plate 80. When the desired angular orientation is achieved, the pull handle 118 is released allowing the head 109 to be moved into a newly selected index hole 106.

In order to allow one rail to slide along the edge of an adjacent rail, the handle 130 of the latching mechanism 120 is lifted, thereby releasing the end portion 124 from frictional engagement with the wall 174 of the rail 12. As described above, in normal operation, the rotatable slide 20B is locked to rail 12B and is latched to rail 12C to prevent the rotatable slide 20B from sliding. If desired, the rotatable slides 20A and 20C have the latching mechanism 120 manipulated to a released position allowing the rotatable slides 20A and 20C to slide on rails 12B and 12C, respectively to a selected position. When the rails are in the selected position, the latching mechanism 120 is manipulated to the locked position thereby locking the rails in the selected position.

When it is desired to have a tension resistance on either end of shuttles 14, resilient cords 176 are attached to a shuttle 14. An example of this is shown in FIG. 2. In a preferred embodiment, three resilient cords are provided. The amount of resistance can be selected by hooking up a selected number of resilient cords 176 to the shuttles 14.

Further, the angular orientation of the hand grip 16 and toe hold 18 can be rotated by lifting the adjustment pin 54 to allow the pin 54 to move into a selected index hole 56. When the desired rotation is accomplished, the pin 54 is released and the pin 54 rests in a selected index hole 56.

As illustrated in FIGS. 1, 2 and 3, many configurations of the full body exercise equipment 10 can be selected. This equipment provides exercise for the whole body and is very effective in increasing muscle mass, improving balance and coordination, increasing range of motion and cardiovascular capacity.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

I claim:

1. An exercise machine comprising:

a first rail including a first end and a second end;

a second rail including a first end and a second end;

a third rail including a first end and a second end;

a fourth rail including a first end and a second end;

wherein the third and fourth rails are located between the first and second rails;

wherein the second end of the first rail is connected to the second end of the third rail via a first angle adjustment mechanisms, the first angle adjustment mechanism being slidably mounted along a length of the third rail;

wherein the second end of the fourth rail is connected to the second end of the second rail via a second angle adjustment mechanisms, the second angle adjustment mechanism being slidably mounted along a length of the fourth rail;

wherein the first end of the third rail is connected to the first end of the fourth rail via a third angle adjustment mechanisms;

wherein each of the first, second, third and fourth rails are generally positioned in the same horizontal plane;

a first extremity support shuttle slidably connected to the first rail, the first extremity support including a handle;

a second extremity support shuttle slidably connected to the second rail, the second extremity support including a handle;

a third extremity support shuttle slidably connected to the third rail, the third extremity support including a foot support and a knee support;

a fourth extremity support shuttle slidably connected to the fourth rail, the fourth extremity support including a foot support and a knee support;

wherein the movement of each of the first, second, third and fourth extremity support shuttles is independent of each other;

wherein the first rail and third rail are oriented at an angle relative to each other and the only connection between the first rail and the third rail is at the second end of the first rail and wherein the second rail and the third rail are oriented at an angle relative to each other and the only connection between the second rail and the fourth rail is at the second end of the second rail;

a first set of resistance bands that connect to the first, second, third and fourth extremity support shuttles that provide a resistance to movement of extremity support shuttles along the rails in at least one direction along the rail.

2. The exercise machine of claim 1, further comprising second set of resistance bands that connect to the first, second, third and fourth extremity support shuttles that along with the first set of resistance bands provide resistance to movement of extremity support shuttles along the rails in both directions along the rail.

3. The exercise machine of claim 1, wherein the exercise machine is configured such that the resistance and the angle of the rails relative to each other can be adjusted by the users without tools.

4. An exercise machine comprising:

a first rail including a first end portion and a second end portion;

a second rail including a first end portion and a second end portion;

a third rail including a first end and a second end;

a fourth rail including a first end and a second end;

wherein the third and fourth rails are located between the first and second rails;

wherein the second end portion of the first rail is connected between the first and second end of the third rail;

wherein the second end portion of the second rail is connected between the first and second end of the fourth rail;

wherein the first end of the third rail is connected to the first end of the fourth rail;

wherein each of the first, second, third and fourth rails are generally positioned in the same horizontal plane;

a first extremity support shuttle slidably connected to the first rail;

a second extremity support shuttle slidably connected to the second rail;

a third extremity support shuttle slidably connected to the third rail;

a fourth extremity support shuttle slidably connected to the fourth rail;

an angle adjustment mechanisms that enable a user to change and set the angles of the first rail relative to the third rail, the fourth rail relative to the second rail, and the third rail relative to the fourth rail;

wherein the movement of each of the first, second, third and fourth extremity support shuttles is independent of each other.

5. The exercise machine of claim 4, wherein the third and fourth extremity supports both include a foot support.

6. The exercise machine of claim 5, wherein the third and fourth extremity supports both include a knee support pad.

7. The exercise machine of claim 4, wherein the only connection between the first rail and the third rail is at the second end portion of the first rail and wherein the only connection between the second rail and the fourth rail is at the second end portion of the second rail.

8. The exercise machine of claim 4, wherein use the first, second, third and fourth rails are configured to cooperatively form a W-shape.

9. The exercise machine of claim 4, wherein the first and second extremity supports both include a handle.

10. The exercise machine of claim 4, further comprising resistance bands that connect to the first, second, third and fourth extremity support shuttles that provide resistance to movement of extremity support shuttles along the rails in at least one direction along the rail.

11. The exercise machine of claim 4, further comprising resistance bands that connect to the first, second, third and fourth extremity support shuttles that provide resistance to movement of extremity support shuttles along the rails in both directions along the rail.

12. The exercise machine of claim 4, wherein the exercise machine is configured such that an amount of resistance to movement and the angle of the rails relative to each other can be adjusted by the user without tools.

13. A method of exercising, the method comprising:

supporting one's left upper extremity on a first shuttle that slides on a first rail;

supporting one's right upper extremity on a second shuttle that slides on a second rail;

supporting one's left lower extremity on a third shuttle that slides on a third rail;

supporting one's right lower extremity on a fourth shuttle that slides on a fourth rail;

wherein at least one of the first, second, third, and fourth rails is arranged such that the rail is at an angle relative to another rail, wherein the angle is less than 180 degrees;

wherein each of the first, second, third and fourth shuttles is configured to move independent of each other;

wherein each of the first, second, third and fourth shuttles is configured to move generally in the same horizontal plane;

executing a first exercise continuously for a period of time, wherein the first exercise includes driving at least one of the first, second, third and fourth shuttle in a reciprocating motion and then subsequently executing a second exercise continuously for a period of time, wherein the second exercise includes driving at least one of the first, second, third and fourth shuttles in a reciprocating motion;

wherein the first and second exercises are different with respect to the repeating movements or the resistance.

14. The method of claim 13, wherein during the first exercise both the first and second shuttles are held stationary while both the third and fourth shuttles are alternatingly driven forward and backwards.

15. The method of claim 13, wherein during the first exercise both the first and third shuttles are driven in an outward direction while the second and fourth shuttles are moved in an inward direction in a crawling like motion.

16. The method of claim 13, wherein during the first exercise the first, second, third and fourth shuttles are driven simultaneously outwardly and subsequently the first, second, third and fourth shuttles are driven simultaneously inwardly.

17. The method of claim 13, wherein each of the first, second, third, and fourth rails are arranged such that the rails are at an angle relative to each other.

18. The method of claim 13, wherein the first, second, third, and fourth shuttles are biased such that they provide resistance against movement along the first, second, third, and fourth rails, respectively, in at least one direction.

19. The method of claim 13, wherein the first, second, third, and fourth shuttles are biased such that they provide resistance against movement along the first, second, third, and fourth rails, respectively, in both directions along the respective rail.

* * * * *

UNITED STATES PATENT AND TRADEMARK OFFICE

CERTIFICATE OF CORRECTION

PATENT NO. : 9,265,986 B1
APPLICATION NO. : 13/999446
DATED : February 23, 2016
INVENTOR(S) : Jacob D. Godak It is certified that error appears in the above-identified patent and that said Letters Patent is hereby corrected as shown below:

In the claims,

Column 6, Line 35
Change "the first angle adjustment mechanisms" to --a first angle adjustment mechanism--

Column 6, Line 39
Change "the second angle adjustment mechanisms" to --a second angle adjustment mechanism--

Column 6, Line 44
Change "a third angle adjustment mechanisms" to --a third angle adjustment mechanism--

Column 7, Line 41
Change "an angle adjustment mechanisms" to --angle adjustment mechanism--

Column 7, Line 57
Change "wherein use" to --wherein in use--

Signed and Sealed this
Thirty-first Day of May, 2016

Michelle K. Lee

Michelle K. Lee
*Director of the United States Patent and Trademark Office*